US010512802B2

(12) United States Patent
Patton et al.

(10) Patent No.: US 10,512,802 B2
(45) Date of Patent: Dec. 24, 2019

(54) ENERGY ABSORBER COVER AND HORIZONTAL LIFELINE SYSTEM INCLUDING THE SAME

(71) Applicant: WERNER CO., Greenville, PA (US)

(72) Inventors: Justin S. Patton, Franklin, PA (US); Tracee Leonardson, Ashtabula, OH (US); Cody Rappoport, Greenville, PA (US)

(73) Assignee: WERNER CO., Greenville, PA (US)

( * ) Notice: Subject to any disclaimer, the term of this patent is extended or adjusted under 35 U.S.C. 154(b) by 109 days.

(21) Appl. No.: 15/789,154

(22) Filed: Oct. 20, 2017

(65) Prior Publication Data

US 2019/0118010 A1 Apr. 25, 2019

(51) Int. Cl.
*A62B 35/04* (2006.01)
*A62B 35/00* (2006.01)

(52) U.S. Cl.
CPC ..... *A62B 35/04* (2013.01); *A62B 35/0056* (2013.01)

(58) Field of Classification Search
CPC ... A62B 35/005; A62B 35/0056; A62B 35/04; B65D 43/021; B65D 2543/00694; B65D 2543/00805; B65D 21/00; B65D 21/02; B65D 21/0201; B65D 21/0204; B65D 21/0209; B65D 21/086; B65D 21/0213; F16F 7/006; A63C 17/002; B32B 2439/40
USPC ..... 220/8, 788, 4.28, 4.21, 345.1, 345.2, 220/DIG. 25
See application file for complete search history.

(56) References Cited

U.S. PATENT DOCUMENTS 828,899 A * 8/1906 Parker ..... B65D 7/045 220/648
1,318,007 A * 10/1919 Gau ..... B25H 3/02 312/244
2,762,411 A * 9/1956 Haskins ..... A61J 3/071 220/4.21
2,899,097 A * 8/1959 Haskins ..... B65D 11/02 220/4.24
3,444,957 A * 5/1969 Gilpin, Jr. ..... F16F 7/00 182/3
4,446,944 A * 5/1984 Forrest ..... A62B 35/04 182/3
4,538,702 A * 9/1985 Wolner ..... A62B 35/04 182/230
5,090,503 A * 2/1992 Bell ..... A62B 35/04 182/5

(Continued)

FOREIGN PATENT DOCUMENTS

GB 2 333 532 A 7/1989
GB 2 217 421 A 10/1989
GB 2 344 628 A 6/2000

*Primary Examiner* — Katherine W Mitchell
*Assistant Examiner* — Shiref M Mekhaeil
(74) *Attorney, Agent, or Firm* — Eckert Seamans Cherin & Mellott, LLC

(57) ABSTRACT

A cover for an energy absorber for use in a horizontal lifeline system includes four cover pieces structured to interlock together to form the cover. Each cover piece includes an interlocking section structured to slide into the interlocking section of another one of the cover pieces, a number of tabs, and a number of tab receivers. The number of tabs are structured to snap together with the tab receivers of another one of the cover pieces and the number of tab receivers are structured to snap together with the tabs of another one of the cover pieces.

20 Claims, 16 Drawing Sheets

(56) References Cited

U.S. PATENT DOCUMENTS 5,143,187 A * 9/1992 McQuarrie ..... A62B 35/0056 182/3
5,174,410 A * 12/1992 Casebolt ..... A62B 35/04 182/3
5,220,977 A * 6/1993 Wolner ..... A62B 35/0037 182/18
5,598,900 A * 2/1997 O'Rourke ..... A62B 35/0056 182/18
5,771,993 A 6/1998 Anderson et al.
6,338,399 B1 * 1/2002 Choate ..... A62B 35/0056 188/374
6,378,651 B1 * 4/2002 Ecker ..... A62B 35/0056 104/115
6,446,936 B1 * 9/2002 Ostrobrod ..... A62B 35/0056 254/368
6,805,220 B2 * 10/2004 Fulton ..... A62B 35/0068 182/3
6,851,516 B2 * 2/2005 Petzl ..... A62B 35/04 182/3
7,188,704 B2 * 3/2007 Renton ..... A62B 35/04 182/18
7,237,650 B2 * 7/2007 Casebolt ..... A62B 35/0093 182/231
8,022,315 B2 * 9/2011 Jolly ..... H02G 3/185 174/481
8,292,028 B2 10/2012 Wise
8,584,799 B1 * 11/2013 Dennington ..... A62B 35/04 182/3
8,701,826 B2 * 4/2014 Smith ..... F16F 7/006 182/3
D732,379 S * 6/2015 Gipson ..... D8/382
9,272,168 B2 3/2016 Parker et al.
9,480,865 B2 11/2016 Naylor et al.
D834,262 S * 11/2018 Patton ..... D29/124
10,125,837 B1 * 11/2018 Fegley ..... F16F 7/006
10,227,787 B2 * 3/2019 Spano ..... E04H 9/14
2002/0046902 A1 * 4/2002 Choate ..... A62B 35/0056 182/3
2003/0111293 A1 * 6/2003 Desjardins ..... A62B 35/0056 182/36
2005/0230184 A1 10/2005 Ansaldo
2008/0060872 A1 * 3/2008 Wise ..... A62B 35/0075 182/3
2008/0179136 A1 * 7/2008 Griffith ..... A62B 35/04 182/5
2009/0235425 A1 * 9/2009 Walker ..... A62B 1/16 2/69
2012/0024640 A1 * 2/2012 Argoud ..... A62B 35/04 188/65.2
2012/0205478 A1 * 8/2012 Balquist ..... A62B 35/04 242/379.1
2013/0105246 A1 * 5/2013 Schlangen ..... F16F 7/006 182/241
2014/0124292 A1 * 5/2014 Montgomery ..... A62B 35/04 182/3
2015/0013079 A1 * 1/2015 Golz ..... A62B 35/0075 8/638
2015/0014092 A1 * 1/2015 Blaise ..... A62B 35/0043 182/5
2017/0369223 A1 * 12/2017 Beardsall ..... G09F 3/0341
2018/0132584 A1 * 5/2018 Boyles ..... F41C 33/06
2018/0317682 A1 * 11/2018 Nguyen ..... A47G 19/2227
2019/0054985 A1 * 2/2019 Bladd-Symms ..... A45C 11/00
2019/0076681 A1 * 3/2019 Patton ..... A62B 35/0056

* cited by examiner

ENERGY ABSORBER COVER AND HORIZONTAL LIFELINE SYSTEM INCLUDING THE SAME

CROSS-REFERENCE TO RELATED APPLICATION

This application is related to co-pending U.S. patent application Ser. No. 15/789,336 filed on Oct. 20, 2017, entitled "LOAD INDICATOR AND HORIZONTAL LIFELINE SYSTEM INCLUDING THE SAME", the entirety of which is incorporated herein by reference.

BACKGROUND

Field

The disclosed concept relates generally to fall protection systems, and in particular, to horizontal lifeline systems. The disclosed concept also pertains to energy absorbers for use in horizontal lifeline systems.

Background Information

In fall protection systems, a worker typically wears a safety harness. In some fall protection systems, the safety harness is attached to a horizontal lifeline system via a lanyard or another attachment mechanism. Horizontal lifeline systems typically span horizontally between attachment points such as anchors in a structure. In an arrest situation, such as when a worker falls, the horizontal lifeline system will deploy to slow and stop the fall of the worker. Horizontal lifeline systems often include an energy absorber that deploys in an arrest situation to reduce the forces applied to the worker in the case of a fall.

Energy absorbers typically consist of packaged tear webbing. In the event of a fall, the forces on the energy absorber cause the webbing to tear apart. The tearing absorbs energy, which slows the fall of the worker and reduces the impact forces on the worker. The webbing is generally packaged in a bag made of fabric. A fabric bag is a simple solution to packaging the energy absorber. However, the fabric bag is susceptible to wear and tear and can expose the webbing to wear and tear as well. There is room for improvement in energy absorbers.

When a horizontal lifeline system is installed, an amount of pre-tension should be applied to hold the horizontal lifeline taut and prevent it from sagging. If the amount of tension applied is too low, the horizontal lifeline system will sag. It is important that a sufficient amount of tension be applied to a horizontal lifeline. However, it is also desirable to have a simple and cost effective manner of determining whether sufficient tension has been applied. There is room for improvement in determining the tension of horizontal lifelines.

SUMMARY

These needs and others are met by embodiments of the disclosed concept in which a cover for an energy absorber includes four cover pieces that interlock together to form the cover.

In accordance with one aspect of the disclosed concept, a cover for an energy absorber for use in a horizontal lifeline system comprises: four cover pieces structured to interlock together to form the cover, each cover piece including: an interlocking section structured to slide into the interlocking section of another one of the cover pieces; a number of tabs; and a number of tab receivers, wherein the number of tabs are structured to snap together with the tab receivers of another one of the cover pieces and the number of tab receivers are structured to snap together with the tabs of another one of the cover pieces.

In accordance with another aspect of the disclosed concept, a horizontal lifeline system comprises: a first termination arrangement structured to attach to a first anchor point; a second termination arrangement structured to attach to a second anchor point; a horizontal lifeline cable coupled to the first termination arrangement; an energy absorber coupled between the first and second termination arrangements, the energy absorber including webbing and a cover enclosing the webbing, the cover comprising: four cover pieces structured to interlock together to form the cover, each cover piece including: an interlocking section structured to slide into the interlocking section of another one of the cover pieces; a number of tabs; and a number of tab receivers, wherein the number of tabs are structured to snap together with the tab receivers of another one of the cover pieces and the number of tab receivers are structured to snap together with the tabs of another one of the cover pieces.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
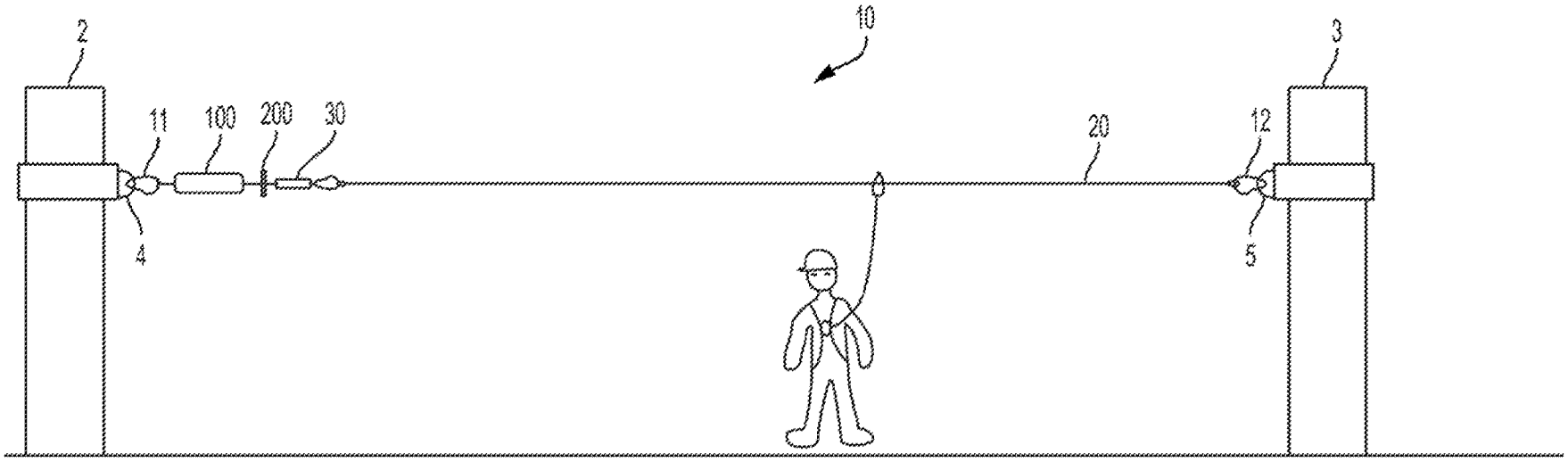
FIG. 1 is a view of a horizontal lifeline system in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

Figure 2:
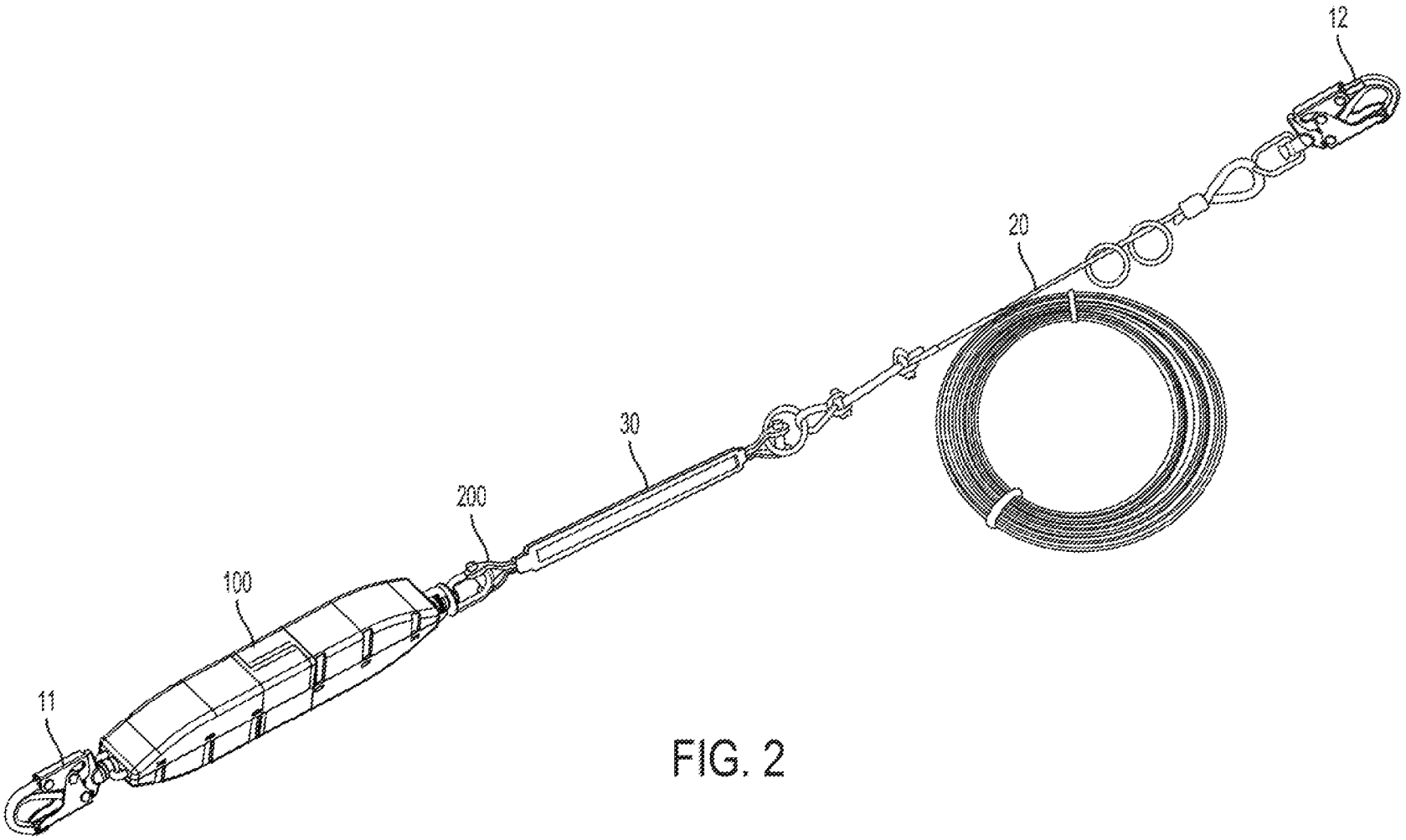
FIG. 2 is a view of elements of the horizontal lifeline system of FIG. 1.

FIG. 1 is an illustration of a horizontal lifeline system 10 in accordance with an example embodiment of the disclosed concept and FIG. 2 is an illustration of elements of the horizontal lifeline system 10 in accordance with an example embodiment of the disclosed concept. The horizontal lifeline system 10 includes termination arrangements 11,12 structured to attach the horizontal lifeline system 10 between anchor points 4,5 on corresponding structures 2,3. The anchor points 2,3 may be located on, for example and without limitation, permanent structures such as a building or other construction. The anchor points may also be located on temporary structures attached to another structure to provide a place to attach the horizontal lifeline system 10. The anchor points 4,5 may include, for example and without limitation, a ring, an eyelet, a bracket, a post, a strap, or any other mechanism that provides a place to attach the horizontal lifeline system 10 to the corresponding structures 2,3. While some examples of anchor points 4,5 have been provided, it will be appreciated by those having ordinary skill in the art that any suitable anchor point may be employed in conjunction with the horizontal lifeline system 10 without departing from the scope of the disclosed concept.

The horizontal lifeline system 10 includes termination arrangements 11,12 provided at each of its ends. The termination arrangements 11,12 are structured to attach to corresponding anchor points 4,5. The termination arrangements 11,12 may include, for example and without limitation, hooks, carabiners, rings, etc. While some examples of termination arrangements 11,12 have been provided, it will be appreciated by those having ordinary skill in the art that any suitable termination arrangements that are capable of attaching the horizontal lifeline system 10 to corresponding anchor points 4,5 may be employed without departing from the scope of the disclosed concept.

The horizontal lifeline system 10 further includes a tensioner 30 and a horizontal lifeline cable 20. The tensioner 30 and the horizontal lifeline cable 20 are disposed between the termination arrangements 11,12. One end of the tensioner 30 is attached to the horizontal lifeline cable 20. The tensioner 30 is coupled, either directly, or indirectly via one or more additional components, to one of the termination arrangements 12. The horizontal lifeline cable 20 is coupled, either directly, or indirectly via one or more additional components, to the other of the termination arrangements 11.

The tensioner 30 is structured to provide tension for the horizontal lifeline cable 20. In some example embodiments of the disclosed concept, the tensioner 30 may be a turnbuckle, such as twist turnbuckle, that may be twisted to increase or decrease the tension on the horizontal lifeline cable 20. However, it will be appreciated by those having ordinary skill in the art, that any suitable device for adjusting the tension of the horizontal lifeline cable 20 may be employed without departing from the scope of the disclosed concept.

The horizontal lifeline system 10 further includes an energy absorber 100 and a load indicator 200. The energy absorber 100 includes a cover 102 (shown in FIG. 3). The cover 102 encloses packed webbing 104 (also shown in FIG. 3). In the event of a fall, the cover 102 breaks apart and the webbing 104 deploys in order to absorb the energy of the fall and reduce the forces on the worker. In some example embodiments of the disclosed concept, the webbing 104 is tear webbing. The tear webbing may be stitched together in the folded shape shown for example in FIG. 3. The forces applied to the webbing 104 during a fall cause the stitching to tear apart and the webbing 104 to unfold. The tearing absorbs energy and slows the worker's fall such that impact forces are reduced. It will be appreciated that other types of webbing 104 or materials may be employed in the energy absorber 100 without departing from the scope of the disclosed concept. The cover 102 will be described in more detail with respect to FIGS. 3-12.

The horizontal lifeline system 10 additionally includes a load indicator 200. The load indicator 200 is structured to provide an indication when the tension in the horizontal lifeline cable 20 reaches a predetermined level. In some example embodiments of the disclosed concept, the load indicator 200 includes a washer that is only able to spin freely once the tension in the horizontal lifeline cable 20 has reached the predetermined level.

Figure 3:
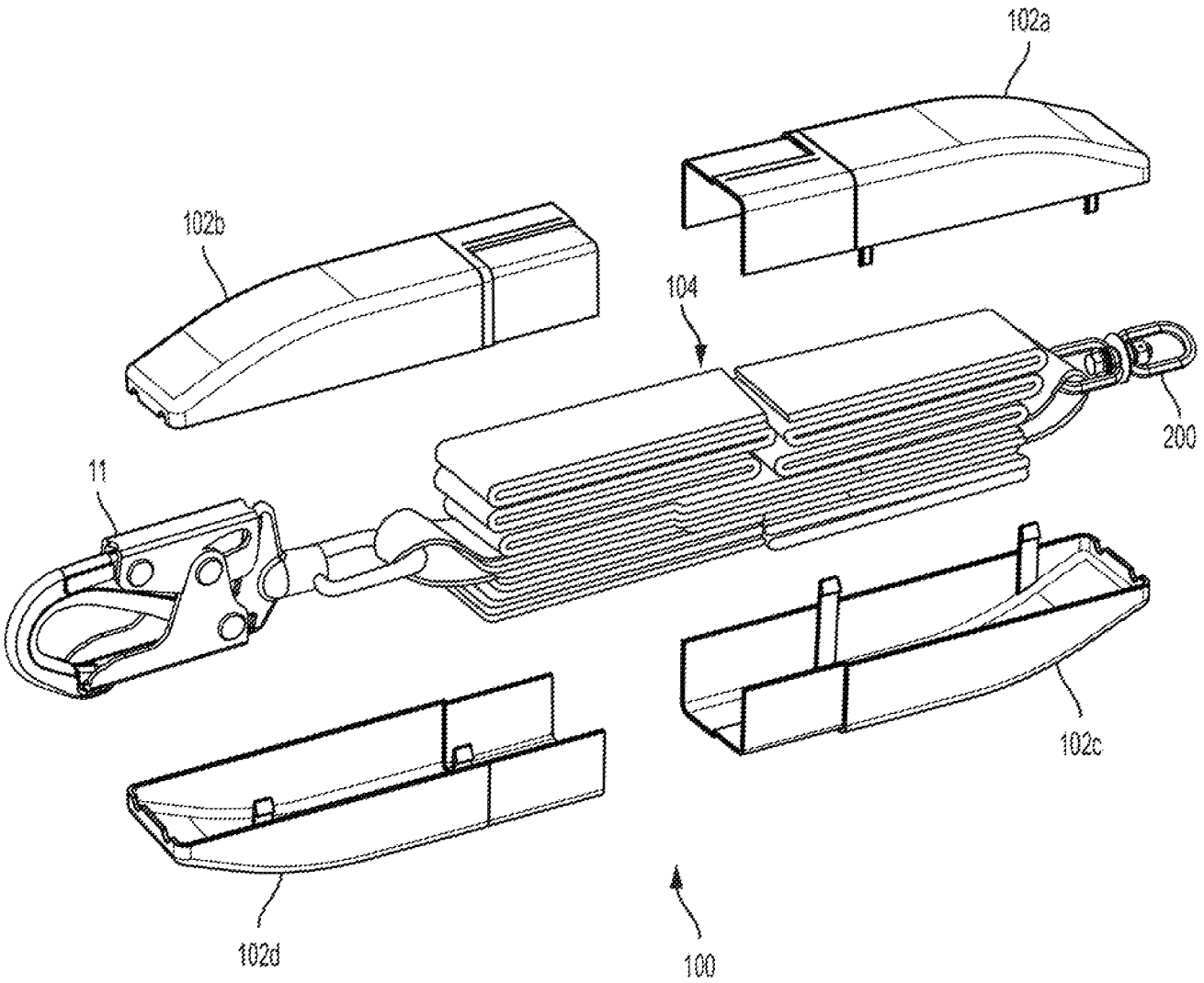
FIGS. 3-6 illustrate steps of assembling a cover for an energy absorber in accordance with an example embodiment of the disclosed concept.
Figure 4:
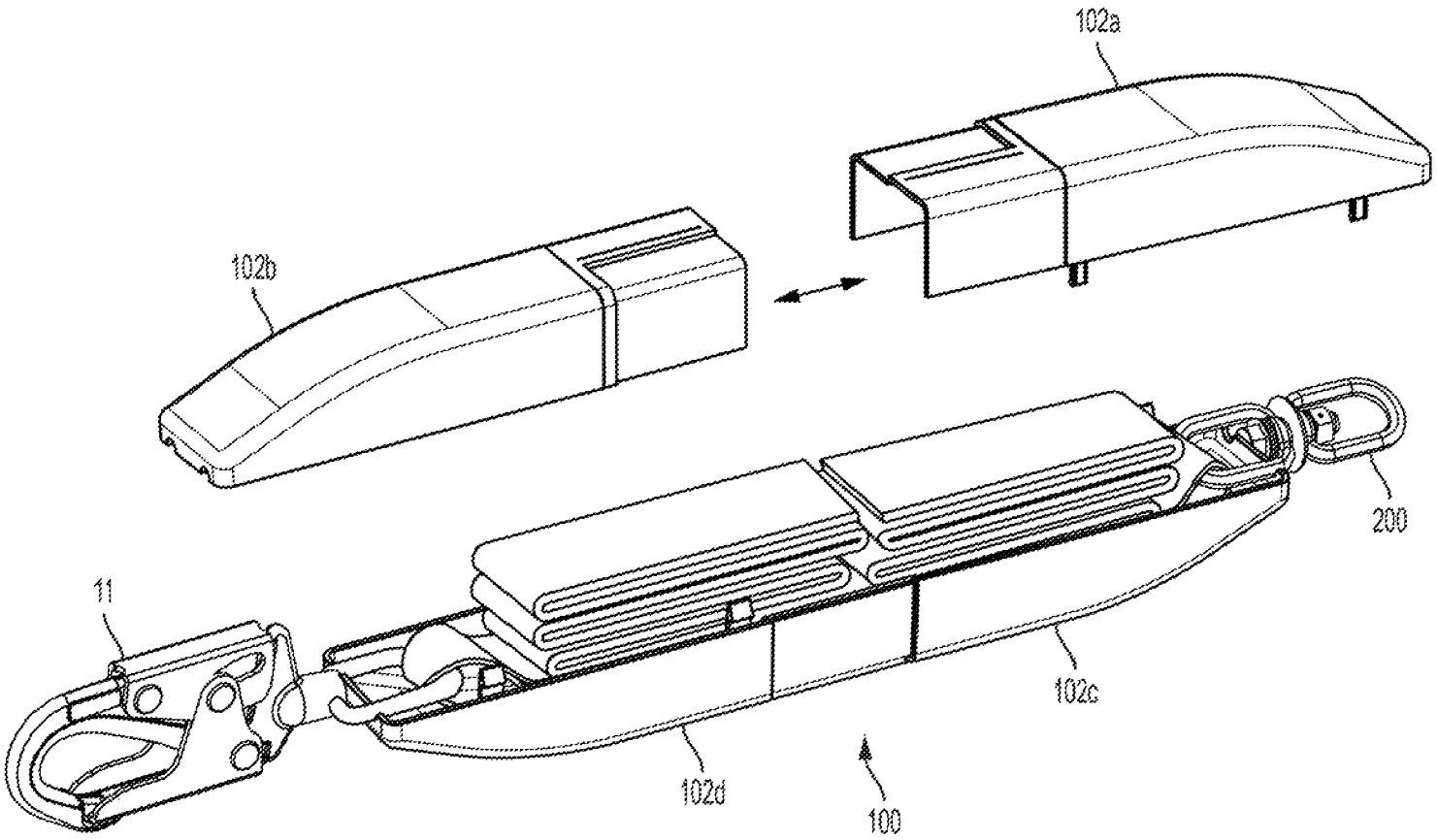
Figure 5:
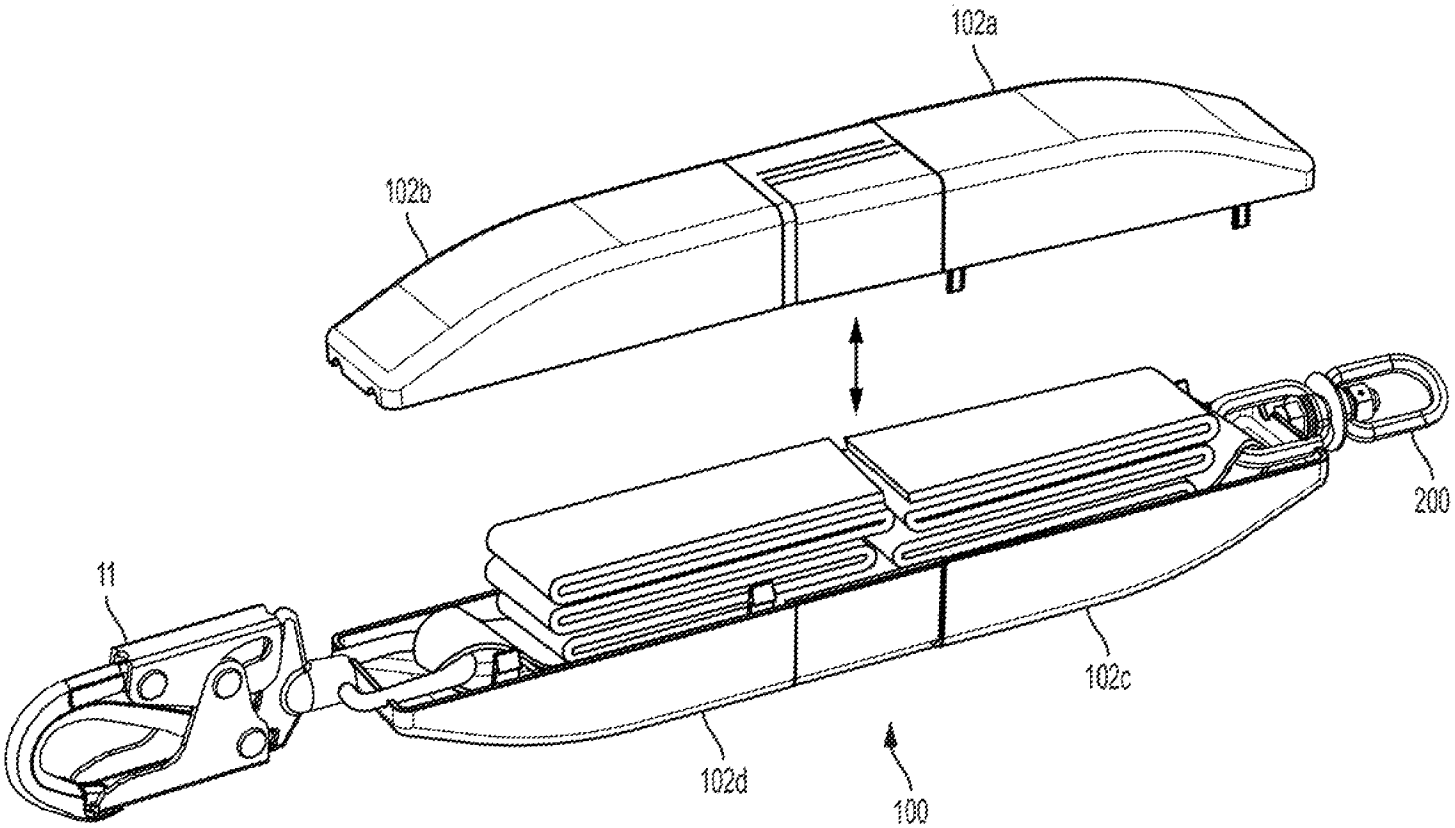
Figure 6:
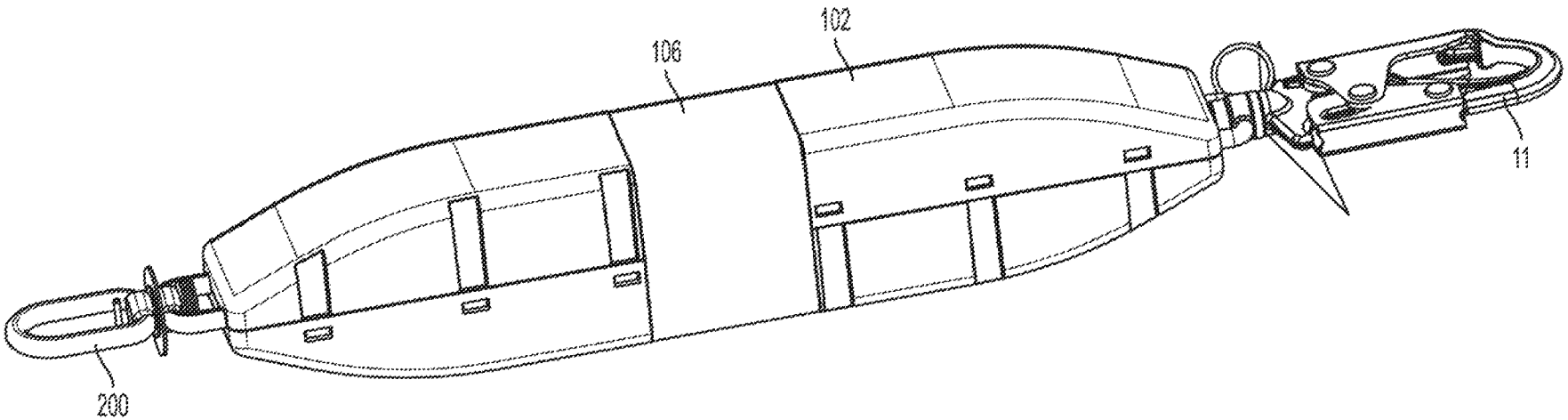

FIGS. 3-6 illustrate an assembly of the energy absorber 100 in accordance with an example embodiment of the disclosed concept. The cover 102 includes four cover pieces 102*a*, 102*b*, 102*c*, and 102*d*. The four cover pieces 102*a*, 102*b*, 102*c*, and 102*d* are structured to interlock together to form the cover 102. An exploded view before the four cover pieces 102*a*, 102*b*, 102*c*, and 102*d* are interlocked together is shown in FIG. 3 and the completed cover 102 after the four cover pieces 102*a*, 102*b*, 102*c*, and 102*d* have been interlocked is shown in FIG. 6.

Intermediate assembly steps are shown in FIGS. 4 and 5. As shown in FIG. 4, the cover pieces 102*a* and 102*b* slide together and cover pieces 102*c* and 102*d* slide together. In the illustration of FIG. 4, cover pieces 102*c* and 102*d* are already joined and cover pieces 102*a* and 102*b* are in the process of being joined. FIG. 5 shows the joining of the combination of cover pieces 102*a* and 102*b* with the combination of cover pieces 102*c* and 102*d*. The combination of cover pieces 102*a* and 102*b* snaps together with the combination of cover pieces 102*c* and 102*d* to complete the cover 102. That is, cover piece 102*a* snaps together with cover piece 102*c* and cover piece 102*b* snaps together with cover piece 102*d*. Mechanisms that facilitate sliding together and snapping together of the cover pieces 102*a*, 102*b*, 102*c*, and 102*d* will be described in more detail with respect to FIGS. 7-11.

FIG. 6 shows the assembled cover 102. In some example embodiments of the disclosed concept, the cover 102 may include a label 106 that is disposed over a central portion of the cover 102. The label 104 may be disposed around interlocking sections of the cover pieces 102*a*, 102*b*, 102*c*, and 102*d*. For example and without limitation, the label 106 may be an adhesive label that prevents the cover pieces 102*a*, 102*b*, 102*c*, and 102*d* from sliding apart. However, the label 106 may be structured such that in the event of a fall, the forces on the cover 102 and label 106 are sufficient to cause the cover pieces 102*a*, 102*b*, 102*c*, and 102*d* to slide apart and allow the energy absorber 100 to deploy and release the webbing 104.

Figure 7:
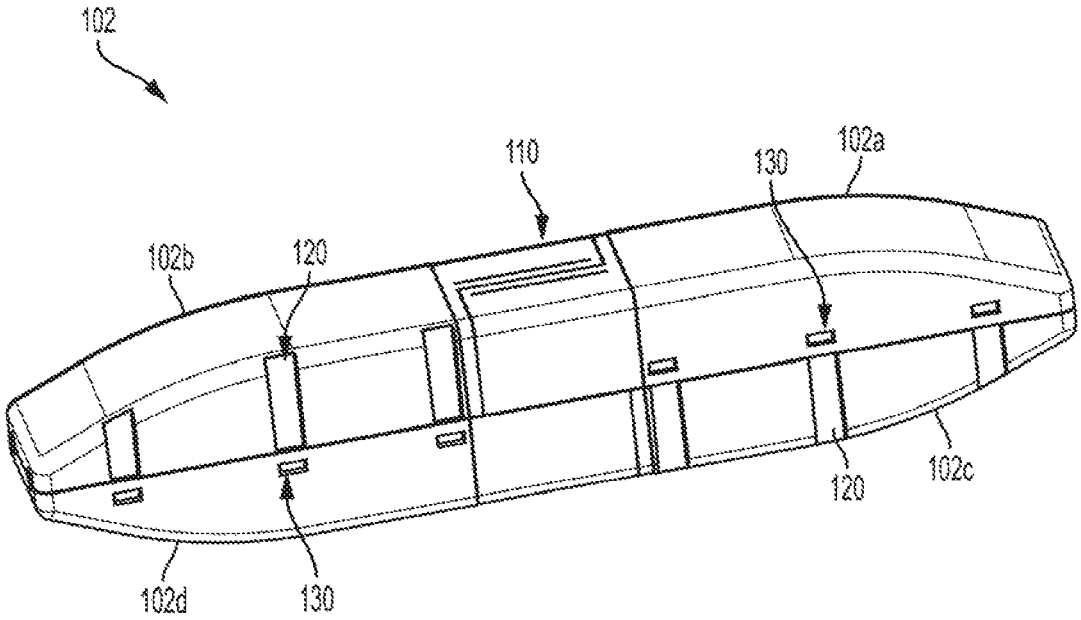
FIG. 7 is a view of an assembled cover for an energy absorber in accordance with an example embodiment of the disclosed concept.

FIG. 7 is a view of the cover 102 and FIGS. 8-11 are views of one of the cover pieces 102*a* in accordance with an example embodiment of the disclosed concept. In some example embodiments of the disclosed concept, each of the cover pieces 102*a*, 102*b*, 102*c*, and 102*d* are substantially the same as each other.

The cover piece 102*a* includes an interlocking section 110, tabs 120, and tab receivers 130. The interlocking section 110 is structured to slide into the interlocking section of another cover piece. The tabs 120 are structured to snap together with the tab receivers of another cover piece and the tab receivers 130 are structured to snap together with the tabs of another cover piece. Sliding and snapping together the four cover pieces 102*a*, 102*b*, 102*c*, and 102*d* in this manner results in the assembled cover 102.

Figure 8:
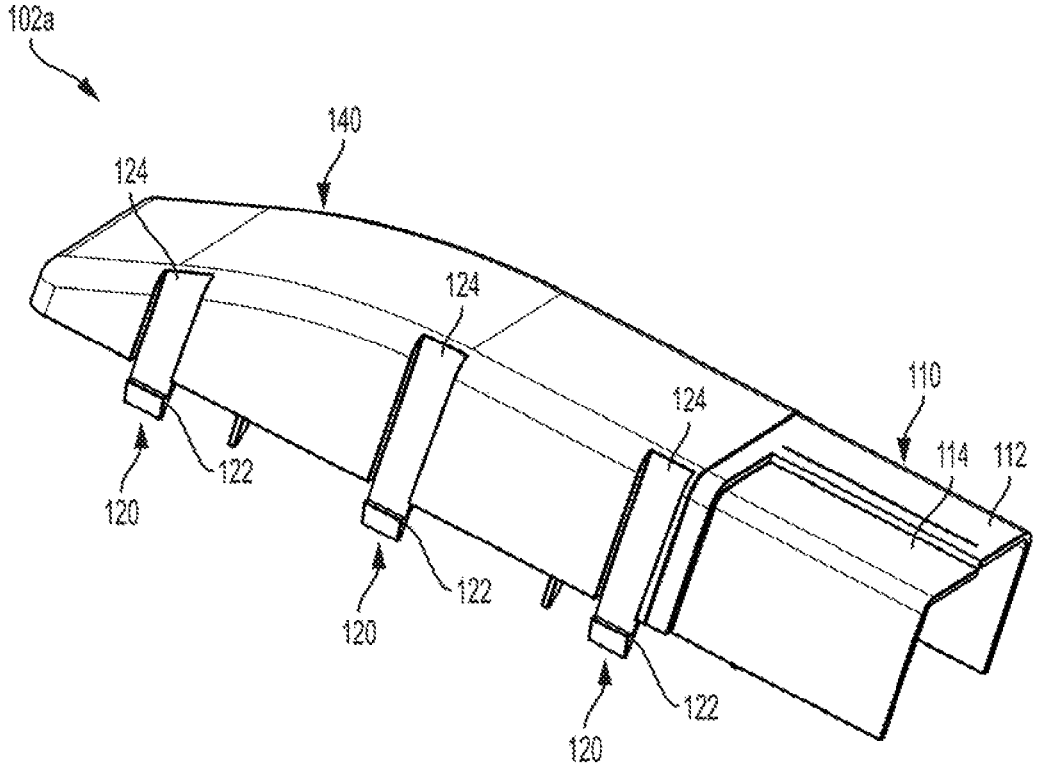
FIGS. 8-11 are views of a cover piece in accordance with an example embodiment of the disclosed concept.
Figure 9:
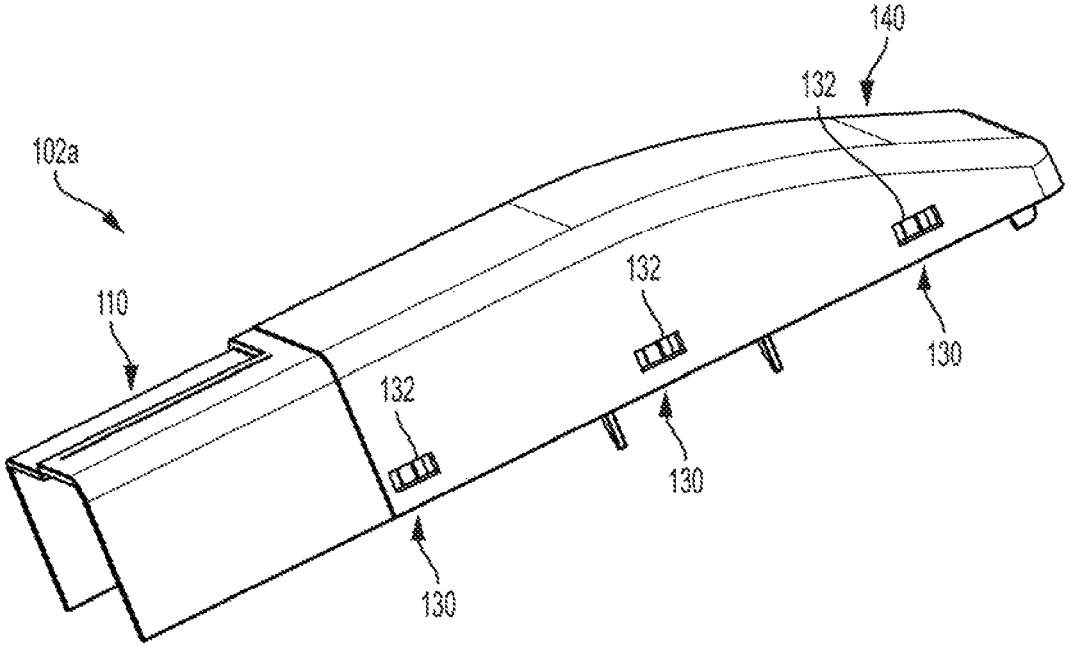

The interlocking section 110 includes a first portion 112 and a second portion 114 (shown in FIG. 8). The first portion 112 is offset with respect to the second portion 114. That is, the top surfaces of the first and second portions 112,114 are offset with respect to each other by a predetermined distance. When the interlocking section 100 of the cover piece 102*a* is slid together with the interlocking section 100 of another one of the cover pieces 102*b* (see FIG. 4), the first portion 112 of the interlocking section 100 of the cover piece 102*a* slides over the second portion 114 of the interlocking section 100 of the other cover pieces 102*b*. Similarly, the second portion 114 of the interlocking section 100 of the cover piece 102*a* slides under the first portion 112 of the interlocking section 100 of the other cover piece 102*b*. Once the cover 102 is assembled, the label 106 may be disposed around the interlocking sections 100 of the cover pieces 102*a*, 102*b*, 102*c*, and 102*d*, as is shown in FIG. 6.

The cover piece 102*a* has a first side and a second side opposite the first side. The tabs 120 are disposed on the first side and the tab receivers 130 are disposed on the second side. When the cover piece 102*a* is snapped together with another cover piece 102*d*, the cover pieces 102*a* and 102*d* are inverted with respect to each other so that the tabs 120 of the cover piece 102*a* align with the tab receivers 130 of the other cover piece 102*d* (see FIG. 5).

Figure 11:
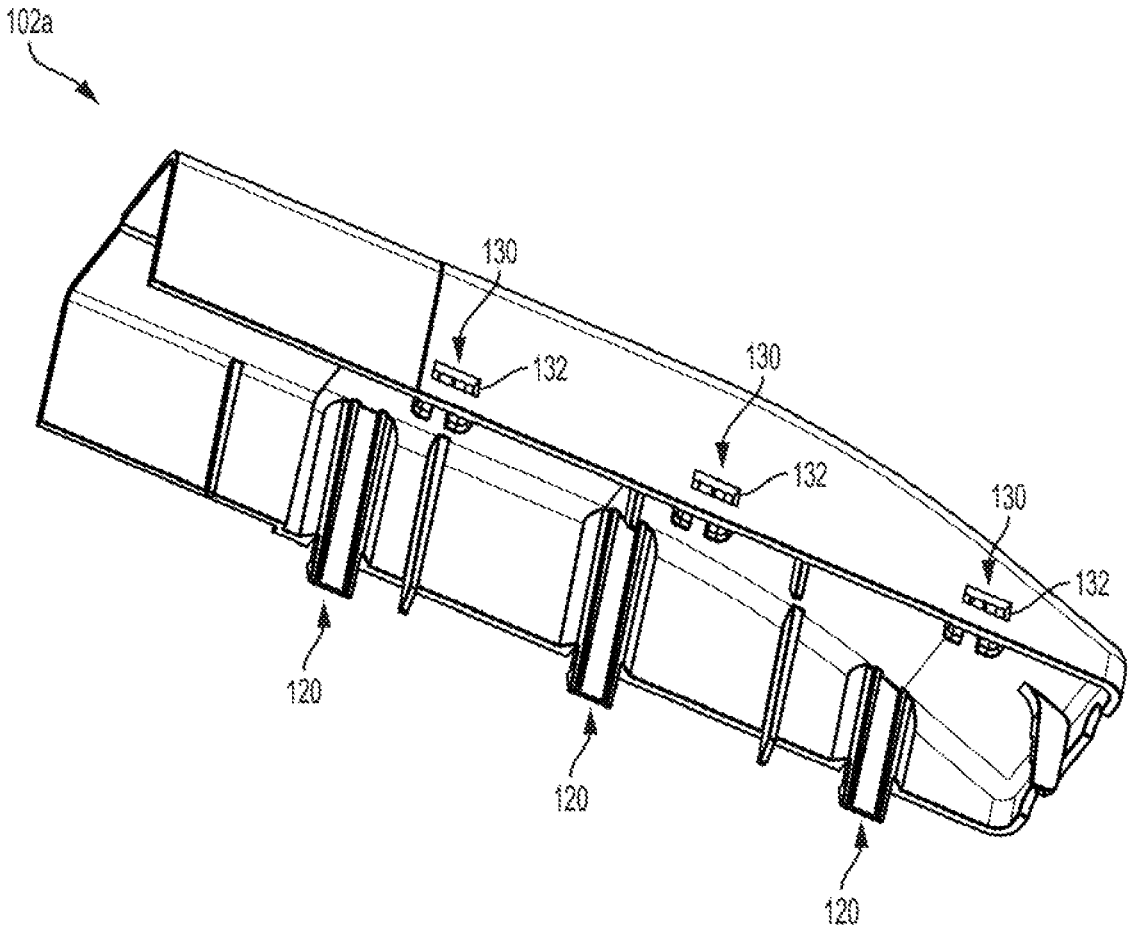

The tabs 120 include a snap member 122 and a depression 124. The tab receivers 130 include an opening 132 and a receiving track 134. The snap member 122 is structured to snap into the opening 132 of the tab receiver 130 of another cover piece 102*d* (see FIG. 5). The tabs 120 are depressed into the side of the cover piece 102*a* via the depression 124. As shown in FIG. 11, the depression 124 causes the tab 120 to extend inward into the interior of the cover piece 102*a*. The tab receiver 130 includes the receiving track 134 that is formed on an interior of the cover piece 102*a*. The receiving track 134 is structured to receive and allow the tab 120 of another cover piece 102*c* to slide into it.

In some example embodiments of the disclosed concept, the tabs 120 extend the height of the first side of the cover piece 102*a* and then continue beyond the end of the first side of the cover piece 102*a*. For example, the depression 124 may extend the entire height of the first side of the cover piece 102*a*. In some example embodiments, the snap member 122 may be disposed at an end of the depression 124 in an area extended beyond the height of the first side of the cover piece 102*a*. In this manner, the snap member 122 may extend into the interior of another cover piece 102*c* and snap into the opening 132 of the tab receiver 130 of the other cover piece 102*c*. Additionally, the tab 120 may extend into the receiving track 134 of the tab receiver 130 of the other cover piece 102*c*.

In some example embodiments, the snap member 122 has a triangular cross-section with a flat portion of the triangular cross-section being structured to corresponding to a side of the opening 132 of the other cover piece 102*c*. The cross-sectional shape of the snap member 122 allows the snap member 122 to easily slide into the tab receiver 130 and snap into the opening 132. However, the snap member 122 will not slide out of tab receiver 130 until the snap member 122 is snapped free from the opening 132.

In some example embodiments of the disclosed concept, the cover piece 102 has 3 tabs 120 and 3 tab receivers 130. The tabs 120 and tab receivers 130 are spaced along the length of the cover piece 102*a*. Each tab 120 has a corresponding tab receiver 130 disposed directly opposite of it so that when the cover piece 102*a* is snapped together with another cover piece 102*c*, the tabs 120 of the cover piece 102 align with the tab receivers 130 of the other cover piece 102*c* and vice versa. It will be appreciated by those having ordinary skill in the art that other numbers of tabs 120 and tab receivers 130 may be employed without departing from the scope of the disclosed concept.

The cover piece 102*a* may have a tapered shape. That is, one end of the cover piece 102*a* has a first height and the opposite end of the cover piece 102*a* has a second height that is less that the first height. The cover piece 102*a* includes a taper section 140. The taper section 140 tapers from the first height to the second height along across a portion of the length of the cover piece 102*a*. The taper section 140 may be disposed at an end of the cover piece 102*a* opposite the interlocking section 110. The resulting cover 102 may have a central portion, including the interlocking sections 110 that has a greater height than its end portions, as shown for example in FIG. 7.

In an example embodiment of the disclosed concept, the four cover pieces include a first cover piece 102*a*, a second cover piece 102*b*, a third cover piece 102*c*, and a fourth cover piece 102*d*, as shown in FIG. 7. In the example embodiment, the four cover pieces 102*a*, 102*b*, 102*c*, and 102*d* join together in the following manner. The interlocking section 110 of the first cover piece 102*a* is structured to slide into the interlocking section 110 of the second cover piece 102*b*, the tabs 120 of the first cover piece 102*a* are structured snap together with the tab receivers 130 of the third cover piece 102*c*, and the tab receivers 130 of the first cover piece 102*a* are structured to snap together with the tabs 120 of the third cover piece 102*c*. The interlocking section 110 of the second cover piece 102*b* is structured to slide into the interlocking section 110 of the first cover piece 102*a*, the tabs 120 of the second cover piece 102*b* are structured snap together with the tab receivers 130 of the fourth cover piece 102*d*, and the tab receivers 130 of the second cover piece 102*b* are structured to snap together with the tabs of the fourth cover piece 102*d*. The interlocking section 110 of the third cover piece 102*c* is structured to slide into the interlocking section 110 of the fourth cover piece 102*d*, the tabs 120 of the third cover piece 102*c* are structured snap together with the tab receivers 130 of the first cover piece 102*a*, and the tab receivers 130 of the third cover piece 102*c* are structured to snap together with the tabs 120 of the first cover piece 102*a*. The interlocking section 110 of the fourth cover piece 102*d* is structured to slide into the interlocking section 110 of the third cover piece 102*c* the tabs 120 of the fourth cover piece 102*d* are structured snap together with the tab receivers 130 of the second cover piece 102*b* and the tab receivers 130 of the fourth cover piece 102*d* are structured to snap together with the tabs 120 of the second cover piece 102*b*.

Figure 12:
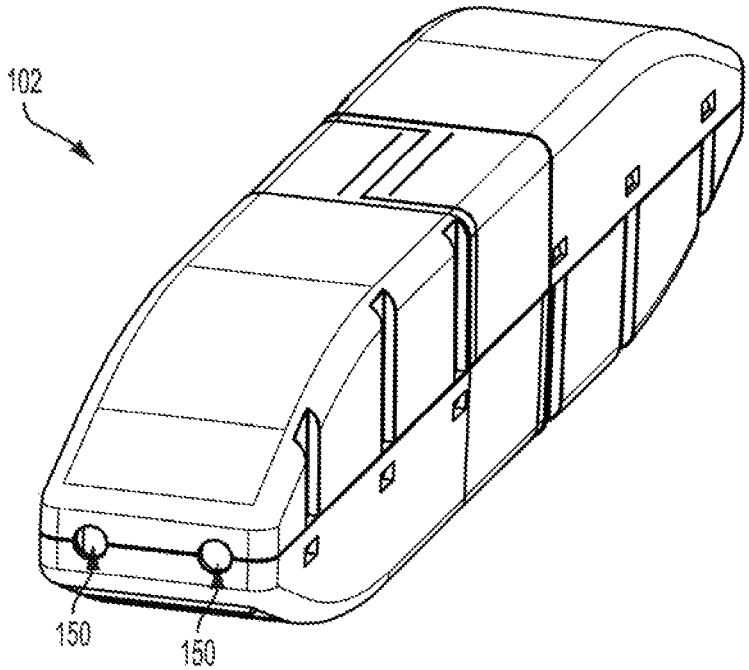
FIG. 12 is a view of an end of a cover for an energy absorber in accordance with an example embodiment of the disclosed concept.

FIG. 12 is another view of the cover 102 in accordance with an example embodiment of the disclosed concept. As shown in FIG. 12, the cover 102 includes circular openings 150 at its end. The other end (not shown) of the cover 102 also includes similar circular openings. The circular openings 150 may receive connectors such as connection rings of the termination arrangement 11 and the load indicator 200. As shown, for example, in FIGS. 5 and 6, the circular openings 150 allow the termination arrangement 11 and load indicator 200 to pass into the cover 102 and connect to the webbing 104.

Figure 10:
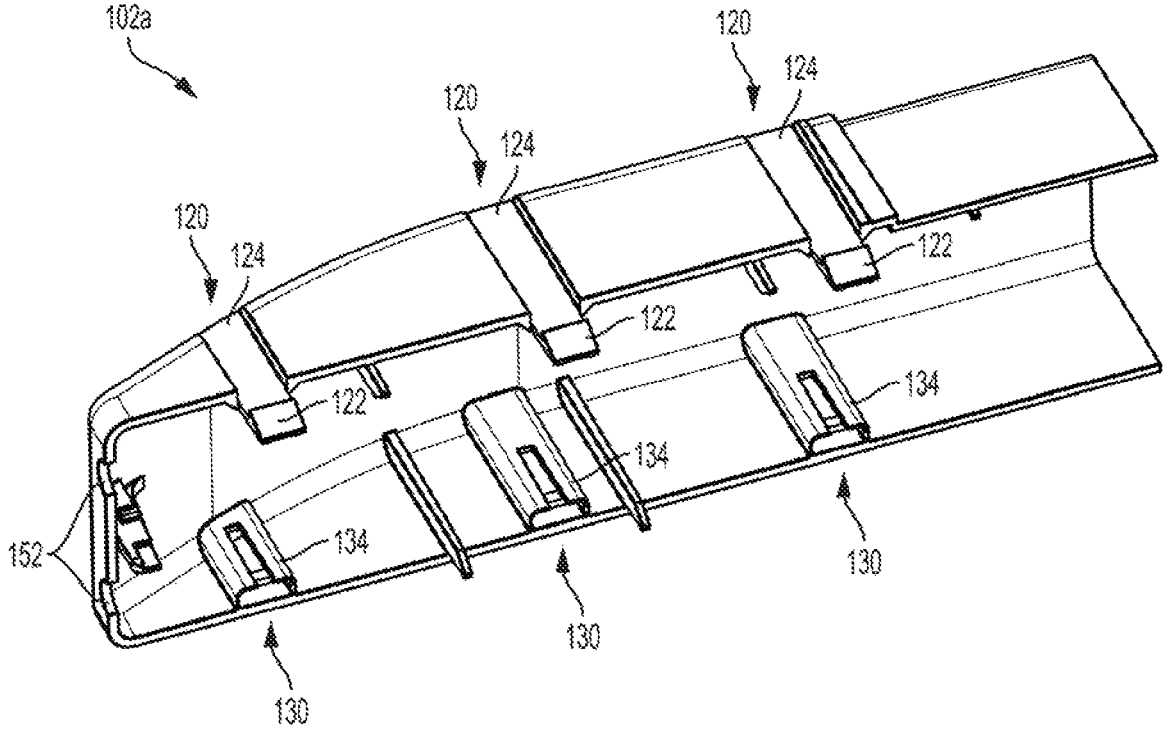

The circular openings 150 are formed from semi-circular openings 152 formed in the end of the cover piece 102*a* (shown in FIG. 10). When the cover piece 102*a* is snapped together with another cover piece 102*d* having the same semi-circular openings 152, the semi-circular openings 152 combine to form the circular opening 150 shown in FIG. 12. The termination arrangement 11 and the load indicator 200 may be connected to the webbing 104 before snapping the cover pieces 102*a*, 102*b*, 102*c*, and 102*d* together (shown in FIG. 5).

In some example embodiments of the disclosed concept, the cover pieces 102*a*, 102*b*, 102*c*, and 102*d* are made of rigid material such as plastic. It will be appreciated that the cover pieces 102*a*, 102*b*, 102*c*, and 102*d* may be composed of other materials without departing from the scope of the disclosed concept.

Figure 13:
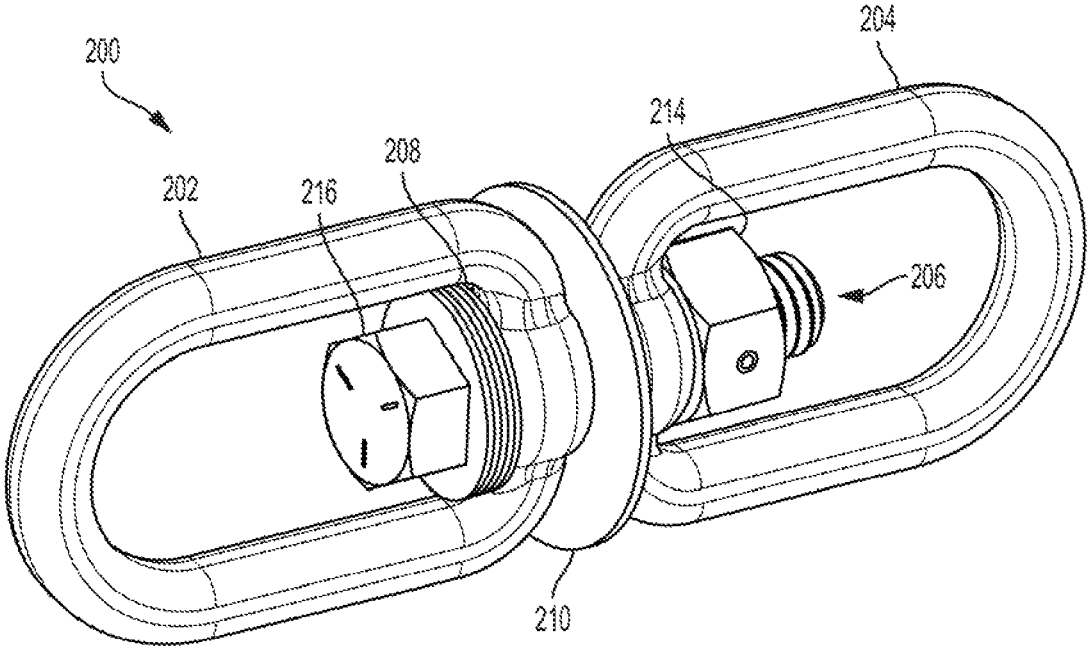
FIGS. 13 and 14 are views of a load indicator in accordance with an example embodiment of the disclosed concept.
Figure 14:
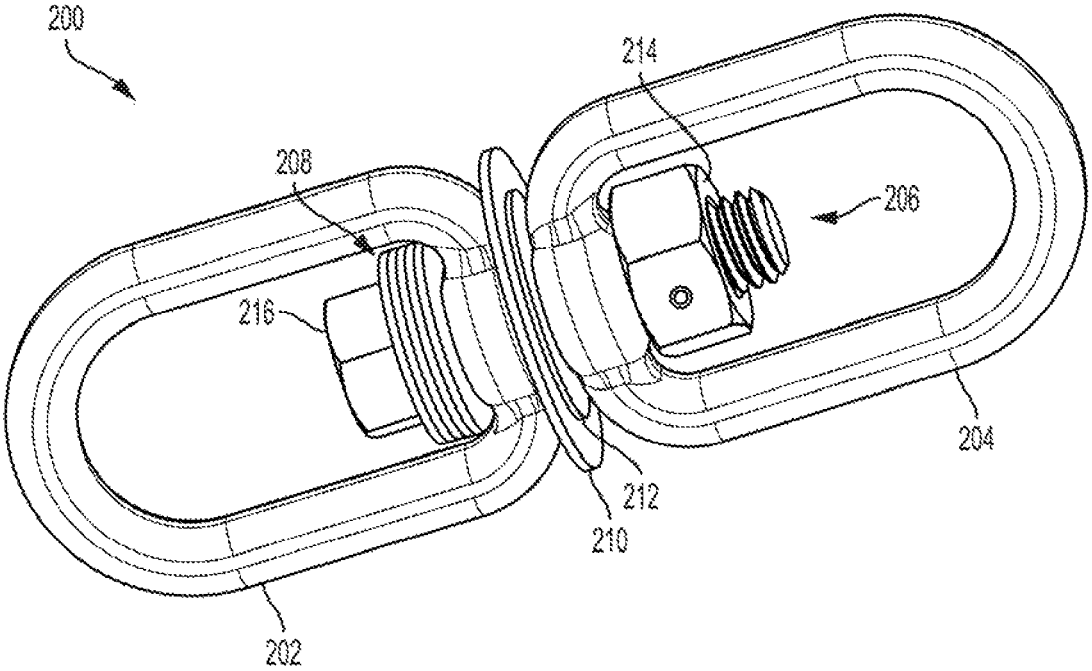
Figure 15:
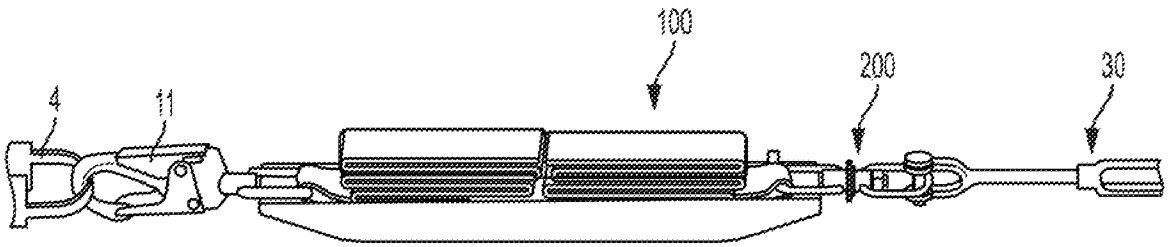
FIG. 15 is a view of an energy absorber and load indicator in accordance with an example embodiment of the disclosed concept.

FIGS. 13 and 14 are views of the load indicator 200 in accordance with an example embodiment of the disclosed concept. The load indicator 200 includes a first connector 202 and a second connector 204. In some example embodiments, the first and second connectors 202,204 are rings. However, other types of connectors may be employed without departing from the scope of the disclosed concept. Pulling the first and second connectors 202,204 in opposite directions applies tension across the load indicator 200. For example, the first connector 202 may be connected to the energy absorber (shown for example in FIG. 15) and the second connector 204 may be connected to the tensioner 30 (also shown for example in FIG. 15). When the load indicator 200 is connected to the horizontal lifeline system 10 in this matter, the tension applied across the load indicator 200 is substantially the same as the tension applied to the horizontal lifeline cable 20.

The load indicator 200 further includes a fastener 206. The fastener 206 is structured to attach the first connector 202 to the second connector 204. In some example embodiments of the disclosed concept the fastener 206 includes a nut 214 and a bolt 216. The bolt 216 is threaded through openings in the first and second connectors 202,204 and then the nut 214 is attached to the bolt such that the first and second connectors 202,204 are disposed between the head of the bolt 216 and the nut 214. It will be appreciated by those having ordinary skill in the art that other types of fasteners may be employed without departing from the scope of the disclosed concept.

The load indicator 200 also includes a moveable member 210 disposed between the first and second connectors 202, 204. The moveable member 210 is also disposed around the fastener 206. In some example embodiments of the disclosed concept, the moveable member 210 is a washer. However, it will be appreciated that other variations of the moveable member 210 may be employed without departing from the scope of the disclosed concept.

A first spring 208 is disposed between the head of the bolt 216 and the first connector 202. The first spring 208 is structured to apply bias to the fastener 206 to pull the first and second connectors 202,204 together. For example, the first spring 208 is disposed between the head of the bolt 216 and the first connector 202 and applies bias forces to the fastener 206 and the first connector 202 in opposite directions. These bias forces pull the nut 214, and thus the second connector 204 towards the first connector 202.

A second spring 212 is disposed between the second connector 204 and the moveable member 210. It will be appreciated that the second spring 212 may also be disposed between the first connector 202 and the moveable member 210. The second spring is structured to apply bias against the moveable member 210 to press the moveable member 210 against the first connector 202.

Figure 16A:
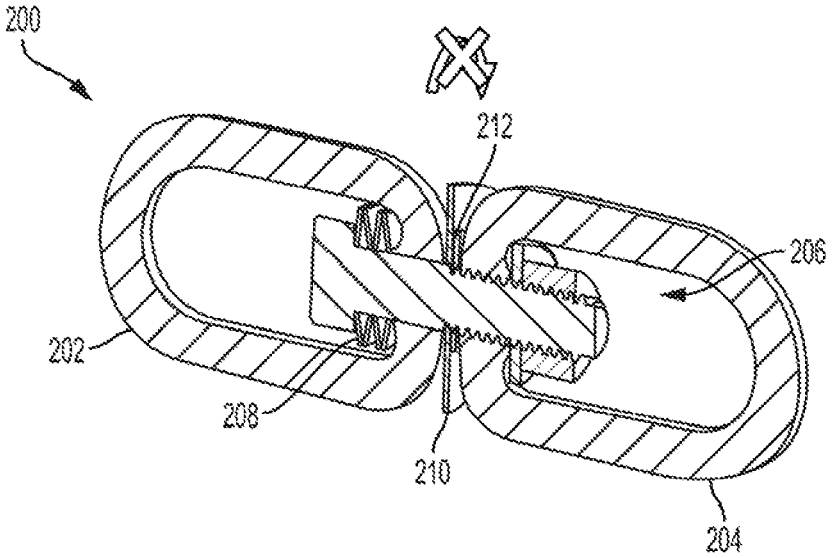
FIGS. 16A and 16B are cross-section views of a load indicator in accordance with example embodiments of the disclosed concept.
Figure 16B:
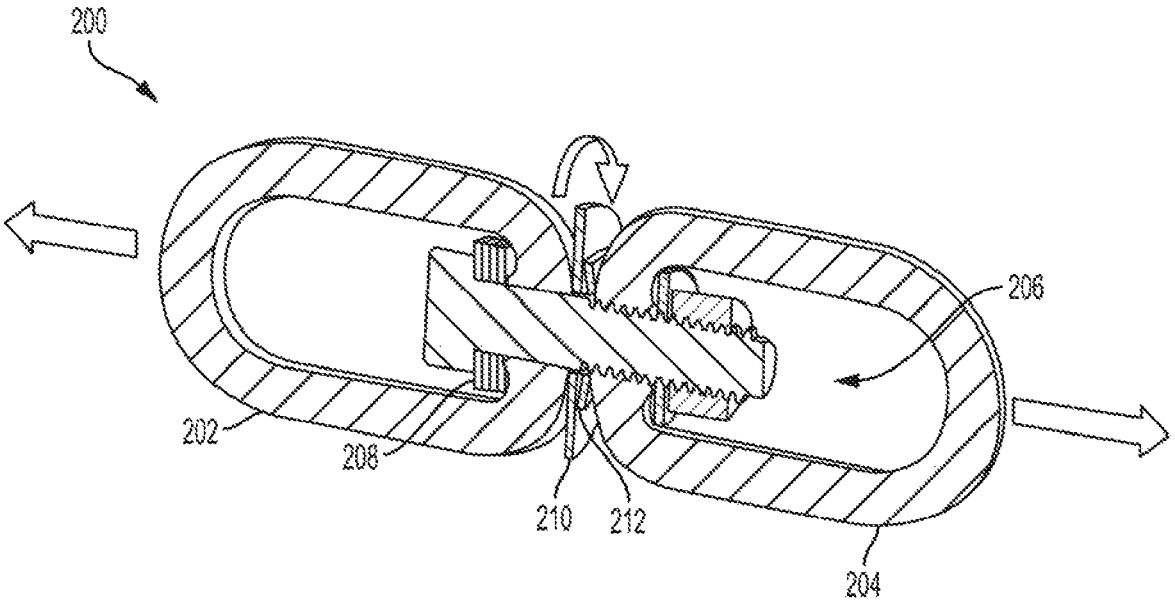

FIGS. 16A and 16B are cross-sectional views of the load indicator 200 in accordance with an example embodiment of the disclosed concept. Operation of the load indicator 200 will be described with respect to FIGS. 16A and 16B.

The load indicator 200 is structured to provide an indication when the tension across it is at or above a predetermined tension level. In some example embodiments of the disclosed concept, the predetermined tension level is about 400 lbs. However, it will be appreciated by those having ordinary skill in the art that any predetermined tension level may be employed without departing from the scope of the disclosed concept. The indication provided by the load indicator 200 is the ability of the moveable member 210 to spin freely about the fastener 206. That is, when the tension across the load indicator 200 is less than the predetermined tension level, the moveable member 210 is not able to spin freely about the fastener 206. When the tension across the load indicator 200 is at or greater than the predetermined tension level, the moveable member 210 is able to spin freely about the fastener 206. In this manner, a worker may attempt to spin the moveable member 210 to check whether sufficient tension has been applied to the horizontal lifeline cable 20.

For example, when the load indicator 200 is manufactured, the bolt 216 and nut 214 are tightened relative to each other such that the second spring 212 is compressed but the first spring 208 is only partially compressed (e.g., in the state shown in FIG. 16A), which leaves a moveable distance between bolt 216 and the first connector 202. The bolt and nut are permanently locked relative to each other such that the distance between them is fixed. The first spring 208 applies a bias force which tends to reduce the distance between the first and second connectors. When the distance between the first and second connectors 202,204 is sufficiently small, the compressive force exerted by the second spring 212 presses the moveable member 210 against the first connector 202 (e.g., in the state shown in FIG. 16A). The pressure and frictional forces between the moveable member 210 and the second spring 212 and first connector 202 prevent the moveable member 210 from spinning freely about the fastener 206. FIG. 16A illustrates the state where the tension across the load indicator 200 is less than the predetermined tension level. As shown in FIG. 16A, the second spring 212 remains compressed while the first spring 208 is expanded. In the state shown in FIG. 16A, the moveable member 210 is unable to spin freely about the fastener 206, indicating that the tension across the load indicator 200 is less than the predetermined tension level.

FIG. 16B illustrates a state where the tension across the load indicator 200 is at or greater than the predetermined tension level. As shown in FIG. 16B, the tension across the load indicator 200 causes the first spring 208 to compress. In other words, the tension is sufficient to counter the bias force applied by the first spring 208, cause the first spring 208 to compress, and pull the first and second connectors 202,204 apart by the distance the first spring 208 has compressed. When the first and second connectors 202,204 are pulled apart, the distance between the first and second connectors 202,204 increases such that the second spring 212 expands and is no longer compressed between the second connector 204 and the moveable member 210. In this state, the second spring 212 cannot bias the moveable member 210 against the first connector 202. In some example embodiments, the second spring 212 is a disc spring such as a belleville washer which can only apply a bias force when it is substantially compressed between two objects. When the objects are separated by a short distance, the second spring 212 becomes decompressed and can no longer apply a bias force. In the state shown in FIG. 16B, the moveable member 210 is not pressed against the first connector 202. As such, the moveable member 210 is able to spin freely. By attempting to spin the moveable member 210, a worker may determine whether there is sufficient tension applied across the load indicator 200.

In some example embodiments of the disclosed concept, the first and second springs 208,210 are able to compress different distances. For example, the first spring 208 may compress a further distance than the second spring 210. That is, the difference between the compressed and expanded length of the first spring 208 is greater than the difference between the compressed and expanded length of the second spring 210. The first and second springs 208,210 may be selected such that the first spring 208 compresses by enough distance at the predetermined tension level such that the distance between the first and second connectors 202,204 increases enough that the second spring 212 expands and no longer biases the moveable member 210 against the first connector 202.

In some example embodiments, the first spring 208 and the second spring 212 may be comprised of one or more disc springs such as belleville washers. However, it will be appreciated that other types of springs may be employed without departing from the scope of the disclosed concept. In an example embodiment, the first spring 208 is comprised of a plurality (e.g., without limitation, 4) disc springs and the second spring 212 is comprised of one disc spring. However, it will be appreciated that different number of disc springs may be employed in the first and second springs 208,212 without departing from the scope of the disclosed concept. In some example embodiments of the disclosed concept, the first spring 208 has a higher biasing force than the second spring 212. It will also be appreciated by those having ordinary skill in the art that the second spring 212 may be omitted. For example, the bias force applied by the first spring 208 may be sufficient to prevent the moveable member 210 from spinning freely when the tension across the load indicator 200 is less than the predetermined tension level.

The energy absorber 100 and the load indicator 200 may be employed together in a horizontal lifeline system 10 such as that shown in FIG. 1. It will also be appreciated that only one of the energy absorber 100 and the load indicator 200 may be employed in a horizontal lifeline system without departing from the scope of the disclosed concept.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A cover for an energy absorber for use in a horizontal lifeline system comprises:

four cover pieces structured to interlock together to form the cover, each cover piece including:

an interlocking section structured to slide into the interlocking section of another one of the cover pieces;

a number of tabs;

a number of tab receivers, wherein the number of tabs are structured to snap together with the tab receivers of another one of the cover pieces and the number of tab receivers are structured to snap together with the tabs of another one of the cover pieces; and a pair of semi-circular indents, wherein the semi-circular indents align with the semi-circular indents of another one of the cover pieces to form a pair of circular openings in the cover; wherein a longitudinal edge of either of the two top cover pieces of the four cover pieces does not overlap a longitudinal edge of either of the two bottom cover pieces of the four cover pieces and; wherein when said four pieces are in an assembled configuration each tab of the number of tabs is insertable into only one respective tab receiver of the number of tab receivers; and wherein when in said assembled configuration an inner volume of the cover remains constant.

2. The cover of claim 1, wherein the interlocking section includes a first portion and a second portion offset with respect to the first portion, wherein the first portion is structured to slide over the second portion of another one of the cover pieces and the second portion is structured to slide under the first portion of another one of the cover pieces.

3. The cover of claim 1, further comprising:

a label disposed around the interlocking sections of the four cover pieces.

4. The cover of claim 1, wherein each cover piece includes:

a first side; and a second side opposite the first side, wherein the number of tabs are disposed on the first side and the number of tab receivers are disposed on the second side.

5. The cover of claim 4, wherein the number of tabs each include a snap member, wherein the number of tab receivers each include an opening, and wherein the snap member is structured to snap into the opening.

6. The cover of claim 4, wherein the number of tabs are depressed into the first side, wherein the number of tab receivers each form a receiving track on an inside of the second side, and wherein the number of tabs are structured to slide into corresponding receiving tracks of the tab receivers of another one of the cover pieces.

7. The cover of claim 4, wherein the number of tabs is three and the number of tab receivers is three.

8. The cover of claim 1, wherein the four cover pieces are substantially the same as each other.

9. The cover of claim 1, wherein each cover piece has a first end having a first height and a second end having a second height, wherein the second height is less than the first height, and wherein each cover piece includes a taper section that tapers from the first height to the second height across a portion of a length of the cover piece.

10. The cover of claim 1, wherein the four cover pieces include a first cover piece, a second cover piece, a third cover piece, and a fourth cover piece, wherein the interlocking section of the first cover piece is structured to slide into the interlocking section of the second cover piece, the tabs of the first cover piece are structured snap together with the tab receivers of the third cover piece, and the tab receivers of the first cover piece are structured to snap together with the tabs of the third cover piece, wherein the interlocking section of the second cover piece is structured to slide into the interlocking section of the first cover piece, the tabs of the second cover piece are structured snap together with the tab receivers of the fourth cover piece, and the tab receivers of the second cover piece are structured to snap together with the tabs of the fourth cover piece, wherein the interlocking section of the third cover piece is structured to slide into the interlocking section of the fourth cover piece, the tabs of the third cover piece are structured snap together with the tab receivers of the first cover piece, and the tab receivers of the third cover piece are structured to snap together with the tabs of the first cover piece, and wherein the interlocking section of the fourth cover piece is structured to slide into the interlocking section of the third cover piece, the tabs of the fourth cover piece are structured snap together with the tab receivers of the second cover piece, and the tab receivers of the fourth cover piece are structured to snap together with the tabs of the second cover piece.

11. The cover of claim 1, wherein the cover is structured to come apart under forces applied to the energy absorber during a fall.

12. A horizontal lifeline system comprising:

a first termination arrangement structured to attach to a first anchor point;

a second termination arrangement structured to attach to a second anchor point;

a horizontal lifeline cable coupled to the first termination arrangement;

an energy absorber coupled between the first and second termination arrangements, the energy absorber including webbing and a cover enclosing the webbing, the cover comprising:

four cover pieces structured to interlock together to form the cover, each cover piece including:

an interlocking section structured to slide into the interlocking section of another one of the cover pieces;

a number of tabs; and a number of tab receivers, wherein the number of tabs are structured to snap together with the tab receivers of another one of the cover pieces and the number of tab receivers are structured to snap together with the tabs of another one of the cover pieces; wherein a longitudinal edge of either of the two top cover pieces of the four cover pieces does not overlap a longitudinal edge of either of the two bottom cover pieces of the four cover pieces and; wherein when said four pieces are in an assembled configuration each tab of the number of tabs is insertable into only one respective tab receiver of the number of tab receivers; and wherein when in said assembled configuration an inner volume of the cover remains constant.

13. The horizontal lifeline system of claim 12, wherein the webbing is tear webbing that is structured to tear apart under forces applied to the energy absorber during a fall, and wherein the cover is structured to come apart under forces applied to the energy absorber during a fall.

14. The horizontal lifeline system of claim 12, further comprising:

a load indicator coupled between the first and second termination arrangements, wherein the load indicator is structured to provide an indication when tension applied to the horizontal lifeline cable is at or greater than a predetermined tension level.

15. The horizontal lifeline system of claim 12, wherein each cover piece includes:

a pair of semi-circular indents, wherein the semi-circular indents align with the semi-circular indents of another one of the cover pieces to form a pair of circular openings in the cover.

16. The horizontal lifeline system of claim 12, wherein the interlocking section includes a first portion and a second portion offset with respect to the first portion, wherein the first portion is structured to slide over the second portion of another one of the cover pieces and the second portion is structured to slide under the first portion of another one of the cover pieces.

17. The horizontal lifeline system of claim 16, wherein the cover further comprises:

a label disposed around the interlocking sections of the four cover pieces.

18. The horizontal lifeline system of claim 12, wherein each cover piece includes:

a first side; and a second side opposite the first side, wherein the number of tabs are disposed on the first side and the number of tab receivers are disposed on the second side.

19. The horizontal lifeline system of claim 18, wherein the number of tabs each include a snap member, wherein the number of tab receivers each include an opening, and wherein the snap member is structured to snap into the opening.

20. The horizontal lifeline system of claim 18, wherein the number of tabs are depressed into the first side, wherein the number of tab receivers each form a receiving track on an inside of the second side, and wherein the number of tabs are structured to slide into corresponding receiving tracks of the tab receivers of another one of the cover pieces.

* * * * *